US006244399B1

(12) United States Patent
Birkestrand

(10) Patent No.: US 6,244,399 B1
(45) Date of Patent: Jun. 12, 2001

(54) COLLAPSIBLE HARD CASE

(75) Inventor: Orville J. Birkestrand, Davenport, IA (US)

(73) Assignee: O.J. Birkenstrand, Davenport, IA (US)

( * ) Notice: Subject to any disclaimer, the term of this patent is extended or adjusted under 35 U.S.C. 154(b) by 0 days.

(21) Appl. No.: 09/376,033

(22) Filed: Aug. 17, 1999

(51) Int. Cl.[7] ..... A45C 7/00

(52) U.S. Cl. ..... 190/103; 190/127; 190/105; 190/107; 190/114

(58) Field of Search ..... 190/127, 124, 190/103, 105, 107, 113, 114; 220/668, 493, 985; 383/119

(56) References Cited

U.S. PATENT DOCUMENTS

| | | | | |
|---|---|---|---|---|
| 584,870 | * | 6/1897 | Giugliano | 190/107 X |
| 4,589,530 | * | 5/1986 | Sher | 190/18 A |
| 4,598,802 | * | 7/1986 | Abenaim | 190/107 |
| 4,781,278 | * | 11/1988 | Sadow | 190/107 |
| 4,951,818 | * | 8/1990 | Johnson | 190/18 A X |
| 4,984,662 | * | 1/1991 | Jacober | 190/107 |
| 5,054,589 | * | 10/1991 | Bomes et al. | 190/18 A |
| 5,103,945 | * | 4/1992 | Kaneko | 190/107 |
| 5,423,404 | * | 6/1995 | Shaw | 190/102 |
| 5,671,698 | * | 9/1997 | Farrugia | D30/109 X |
| 5,918,711 | * | 7/1999 | Godshaw | 190/107 |
| 6,076,485 | * | 6/2000 | Peeples et al. | 160/107 X |

* cited by examiner

*Primary Examiner*—Allan N. Shoap
*Assistant Examiner*—Tri M. Mai
(74) *Attorney, Agent, or Firm*—Cesari and McKenna

(57) ABSTRACT

A collapsible case comprises a closed loop of flexible sheet material for forming the top, bottom and sidewalls of the case, the loop having front and rear edges defining front and rear openings into the interior of the loop. A pair of similar panels form the front and rear walls of the case, each panel including a sheet of flexible material having a perimeter, stiffeners attached to the sheet so as to tension and stiffen the sheet into a selected shape and fasteners for fastening the perimeter of the sheet to the corresponding edge of the loop so that when the panels are fastened to the loop, the loop assumes the selected shape and when said panels are unfastened from the loop and the stiffeners are detached from the sheets, the loop and sheets may be collapsed and consolidated.

24 Claims, 3 Drawing Sheets

COLLAPSIBLE HARD CASE

This invention relates to luggage. It relates more particularly to a collapsible hard case for transporting articles of one kind or another. The case is especially adapted to contain and transport a foldable bicycle.

BACKGROUND OF THE INVENTION

There are two basic types of luggage namely soft side luggage and rigid luggage such as cases and trunks. The former type has an advantage in that it can be crushed or folded up so that it occupies a minimum amount of space when not in use. Also, the walls of the luggage piece, being flexible, allow for certain amount of overpacking. However, the same attribute means that fragile articles in the luggage can be damaged if the luggage piece is handled roughly or impacted from without. A hard case, on the other hand, having rigid walls, protects the case contents. It is disadvantaged in that when empty, it takes up a relatively large space in a closet or storage area.

It would be desirable, therefore, to be able to provide a luggage piece which has the advantages of both hard and soft side luggage, with none of the disadvantages.

SUMMARY OF THE INVENTION

Accordingly, it is an object of the invention to provide an improved luggage piece.

Another object of the invention is to provide a case which, when erect, has relatively rigid walls, but which can be collapsed when the case is not in use.

Another object of the invention is to provide a collapsible hard case which can be erected and collapsed quite easily.

Yet another object of the invention is to provide a collapsible case which protects even fragile articles that may be within the case.

A further object of the invention is to provide a collapsible hard case especially suitable for transporting a foldable bicycle.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present case or container has top, bottom and opposite side walls formed from a continuous strip of flexible sheet material arranged in a loop. Sewed into the loop at spaced apart locations therealong is a series of transverse rigid battens which extend substantially the entire width of the loop perpendicular to the edges thereof. Thus, while the loop is rigid in the lateral direction, it is flexible in the longitudinal direction, i.e., in the direction of the loop. The case also has mirror-image front and rear panels which can be opened. Each panel is provided with removable relatively rigid struts which, when in place, rigidify the panel. Also, fasteners are provided on the edges of each panel which connect to mating fasteners on the adjacent edges of the loop. Thus, when the front and rear panels are fastened to the opposite edges of the loop, the panels support the loop in an erect position wherein the loop has the same general shape as the panels.

As we shall see, the case may be fitted with wheels and a strap or handle similar to those on conventional suitcases so that the case looks like a piece of conventional roll away luggage.

However, due to its aforesaid novel construction, the case has all of the advantages of both rigid luggage and soft side luggage and none of the disadvantages thereof. More particularly, the removable struts in the front and rear panels not only maintain the shape of the case, but also protect the case contents from impacts against the front and rear of the case. On the other hand, impacts against the other walls of the case are resisted by the battens incorporated into the fabric material loop that forms those walls.

When loading or unloading the case, the front or rear panel may be opened, the other panel maintaining the shape of the case. When the case is not in use, it may be collapsed by opening both panels and removing the struts therein. This will allow the panels to be folded up within the loop. Without the panels to support it, the loop is also flexible in the longitudinal direction and can be rolled up to form a compact relatively small volume package which can be conveniently placed in a closet or other storage area.

As will become apparent, the collapsible hard case described herein is relatively easy and inexpensive to make in quantity. Furthermore, it can be erected and collapsed quite easily without a need for any tool and, when collapsed, it occupies a minimum amount of space. For instance, when the case is used to house a foldable bicycle, once the bicycle is removed from the case and unfolded, the case may be collapsed and strapped to a carrier behind the seat of the bicycle.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF AN ILLUSTRATIVE EMBODIMENT

Figure 1:
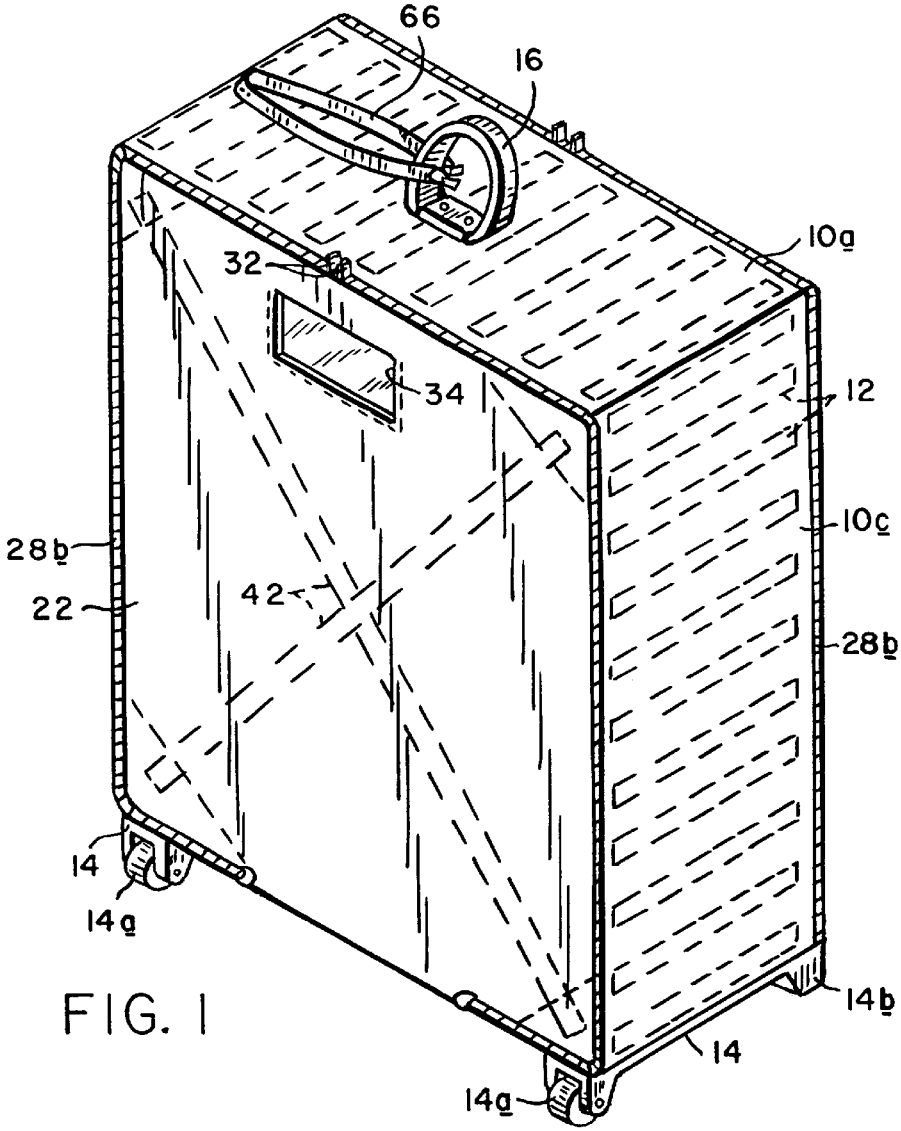
FIG. 1 is a perspective view of a collapsible hard case incorporating the invention, showing the case in its erect and closed condition.
Figure 3:
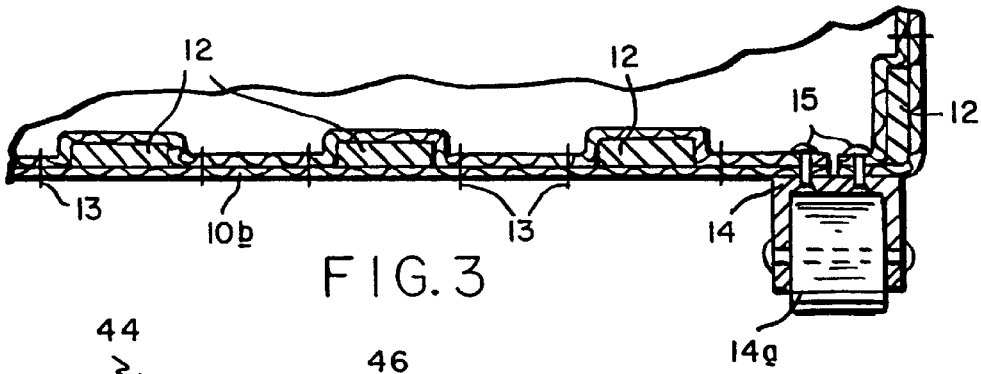
FIG. 3 is a sectional view taken along line 3—3 of FIG. 2.
Figure 2:
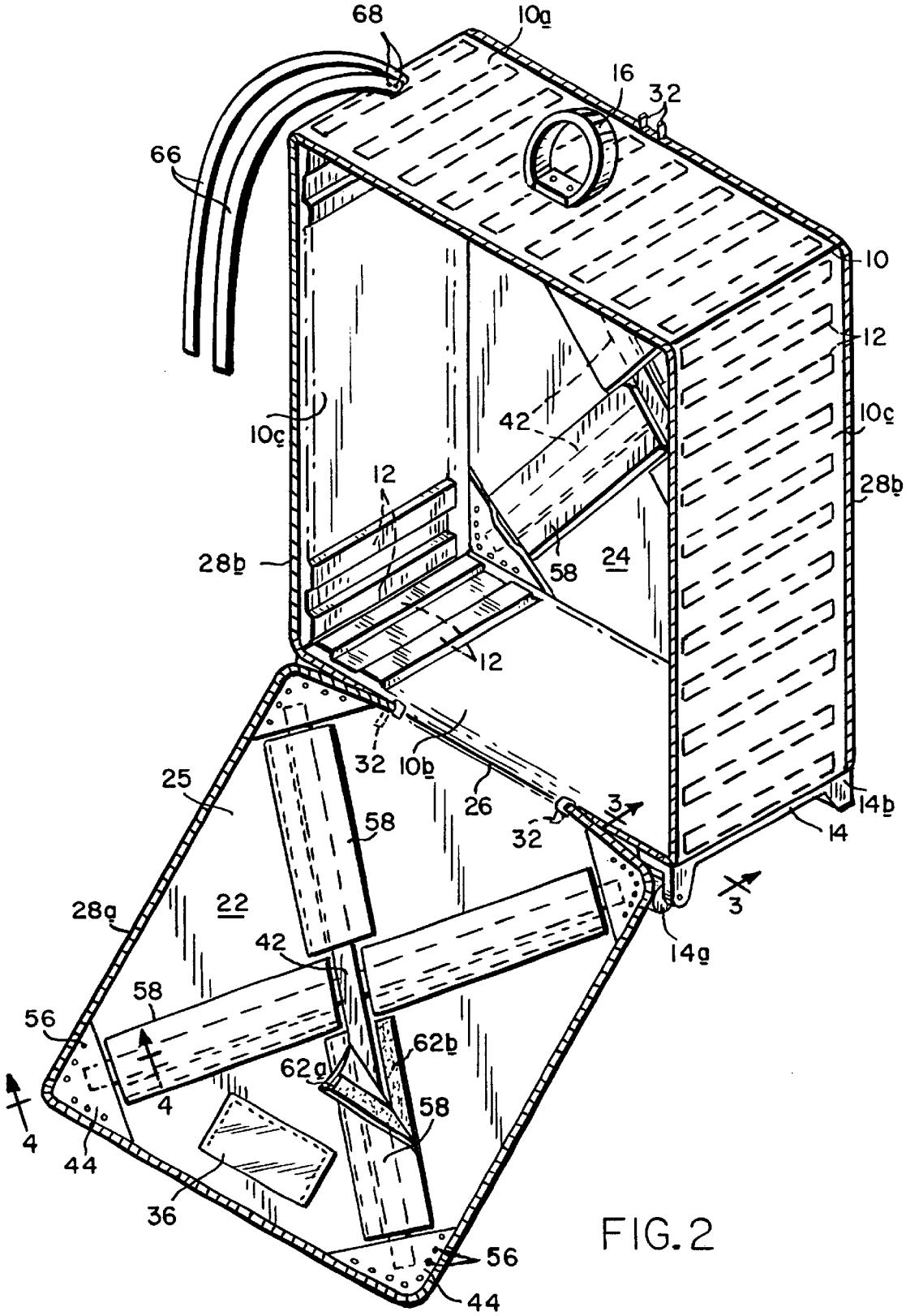
FIG. 2 is a similar view of the FIG. 1 case with the front panel of the case being open.

Referring to FIGS. 1 and 2 of the drawings, the collapsible hard case depicted in the drawings is rectilinear because it is specifically designed to contain a foldable bicycle. However, it will become obvious that the case could have some other shape such as a cylinder, polyhedron, etc. In any event, the illustrated case has a top wall 10*a*, a bottom wall 10*b* and a pair of opposite sidewalls 10*c*, 10*c*. All of these walls are formed by an at least two-ply strip of flexible, weather-resistant, durable material such as woven nylon. The opposite ends of the strip are brought together to form a closed loop 10 having front and rear edges. Loop 10 incorporates a multiplicity of rigid, transverse battens or slats 12 positioned between the loop plies. The battens 12 are spaced apart all around the loop and extend substantially the full width of the loop perpendicular to the edges thereof. The battens are held in place by stitching together the plies of loop 10 between the battens as indicated at 13 in FIG. 3. Preferably, a pair of rigid brackets 14 are secured by rivets 15 to the underside of bottom wall 10*b* at the opposite ends of that wall, each bracket 14 supporting a wheel or roller 14*a* and a foot 14*b* at opposite ends of the bracket as shown in that figure. The opposite ends of the strip that are brought together to form loop 10 are preferably secured together and hidden by one of the brackets 14. Also, a flexible strap 16 is secured to top wall 10*a* so that the case can be pulled along on wheels 14*a*.

The case depicted in FIGS. 1 and 2 also includes a front panel 22 and a rear panel 24, the perimeters of the panels having substantially the same length as the loop edges. Each panel is a mirror image of the other. Therefore, we will only describe front panel 22 in detail. As best seen in FIG. 2, front panel 22 comprises a rectangular sheet 25 of flexible material which may be the same material forming loop 10. One edge of sheet 25 is secured to the front edge of loop 10 to form a hinge 26. In the illustrated case, sheet 25 is secured to the bottom wall 10*b* of the case and the hinge 26 extends along the middle third of the sheet width. Means are provided for releasably fastening the free edges of sheet 25 to the front edge of loop 10. In the illustrated case, such fastening is effected by a zipper slide 28*a* which extends around the perimeter of sheet 25 except for hinge 26 and a mating zipper slide 28*b* which extends along the front edge of loop 10 except for hinge 26. The two slides may be connected together by a pair of zipper sliders 32. Of course, in lieu of a zipper, other means such as hook and loop fasteners, snap fasteners or the like could be used to releasably fasten panel 22 to loop 10.

A rectangular opening 34 may be cut in panel 32 and a rectangular patch 36 may be stitched to the rear or inside surface of panel 22 to form a pocket to retain a transparent window and a card bearing owner information which would be visible through the window.

By itself, sheet 25 is flexible as noted above. In order to rigidify that panel 22, a pair of elongated stiff, but resilient struts or slats 42 are incorporated into the panel. In the illustrated case having rectangular front and rear walls, the struts 42 extend between opposite corners of the panel so as to intersect in the middle of the panel forming a cross. As we shall see, these struts are releasably secured to the sheet 25 so that when the struts are in place, the panel 22 retains its rectangular shape and is relatively rigid. On the other hand, when the struts 42 are removed from panel 22, the sheet 25 is quite flexible and may be folded or rolled up.

When panel 22, with its struts 42 in place, is secured to the front edge of loop 10 by zipper sliders 32, the front of loop 10 assumes the rectangular shape of the rigid panel 22. Similarly, when the mirror-image rear panel 24 is zippered up to the rear edge of loop 10, the rear of the case is rigidified. Thus, when panels 22 and 24 are closed, loop 10 assumes the shape of those panels. In other words, if circular front and rear panels were secured to opposite edges of loop 10, the loop would assume a cylindrical shape. On the other hand, when both of the front and rear panels 22, 24 are open, loop 10, being flexible around its perimeter, has a free form and may assume any shape and will collapse.

Figure 4:
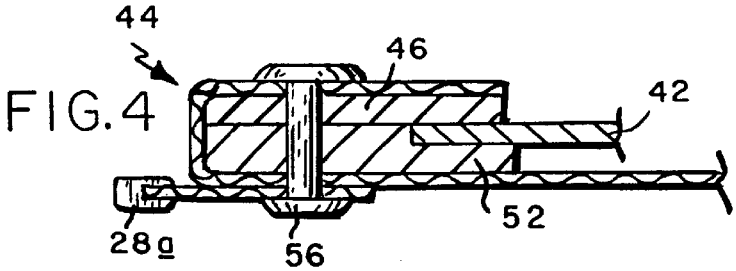
FIG. 4 is a sectional view taken along line 4—4 of FIG. 2.

Referring to FIG. 2, the opposite ends of each strut 42 is secured to opposite corners of the sheet 25 comprising front panel 22 by capturing those ends in pockets 44 formed at those corners. As best seen in FIG. 4, each pocket 44 comprises a triangular plate 46 made of metal, plastic or other suitable rigid material. A slot 48 extends in from the hypotenuse of the plate, said slot being sized to receive an end segment of a strut 42. The open side of the slot is closed by a second rigid triangular plate 52. Sheet 25 has an extension 54 at each corner of the sheet which may be folded around the two legs of each plate so as to cover the plate and this assemblage, along with the zipper slide 28*a*, are secured to sheet 25 by rivets 56 spaced along the legs of the two triangular plates. Alternatively, the extensions may be substituted for by separate triangular patches stitched to the sheet 25.

The length of each strut 42 is more or less the same as the distance between the inner ends of the slots 48 in the pockets 44 at opposite corners of panel 22. Each strut 42 may be secured to panel 22 by flexing the strut and inserting its opposite ends into the pockets 44 at opposite corners of panel 22. When the strut is released, it straightens out and stretches the panel diagonally. When both struts are in place, the entire panel 22 becomes taut.

Although it is not absolutely necessary, additional means may be provided to secure struts 42 to sheet 25 along substantially the entire lengths of those struts. In the illustrated case, this additional securement is effected by rectangular flaps 58 of flexible material stitched along an edge to sheet 25 at one side of each installed strut 42. The flaps extend from locations adjacent to the strut intersection to the pockets 44. Each flap 58 may be folded over the adjacent strut and the free edge of the flap releasably secured to panel 22 on the opposite side of the strut. In the illustrated case, the free edge of each flap is secured to the panel by cooperating hook and loop fastener strips 62*a*, 62*b* as shown in FIG. 2.

As mentioned above, the rear panel 24 at the back of the case is a mirror image of panel 22 and it is made and assembled in exactly the same way as panel 22. As with panel 22, the rear panel 24 may be releasably secured at its perimeter to a zipper slide 28*b* at the rear edge of loop 10.

Once the front and rear panels 22 and 24 are secured to loop 10, the panels, being rigid due to their struts 42, maintain loop 10 in an erect rectangular shape. The battens 12 in loop 10 provide protection for the case contents all around the perimeter of the case while the front and rear panels, reinforced by struts 42, afford such protection at the front and rear of the case. Thus, the erect case has the attributes of a conventional case with rigid walls. In this, the case is able to enclose and protect articles such as personal items, samples, electronic components and even a relatively heavy item such as a foldable bicycle.

Figure 5:
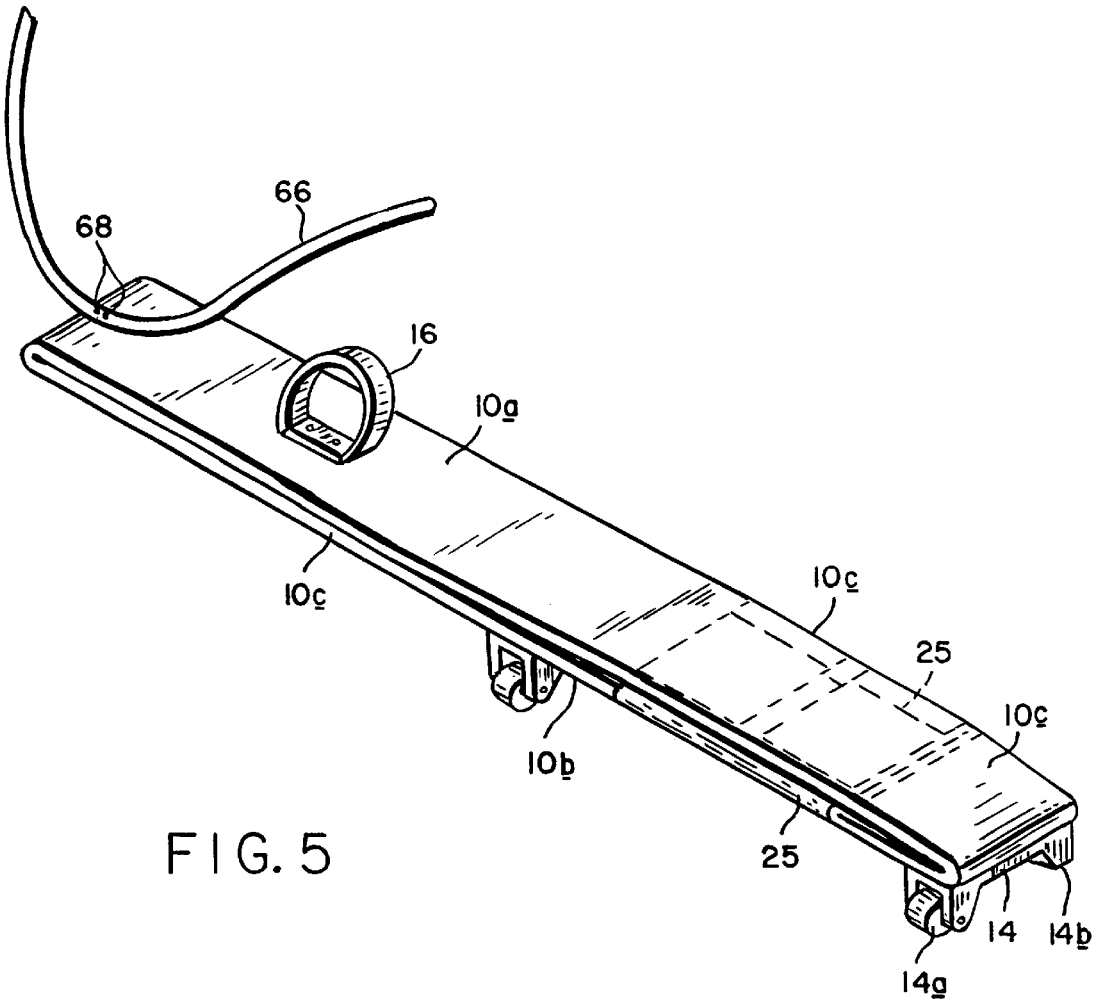
FIG. 5 is a view similar to FIG. 1 showing the case in a collapsed condition.
Figure 6:
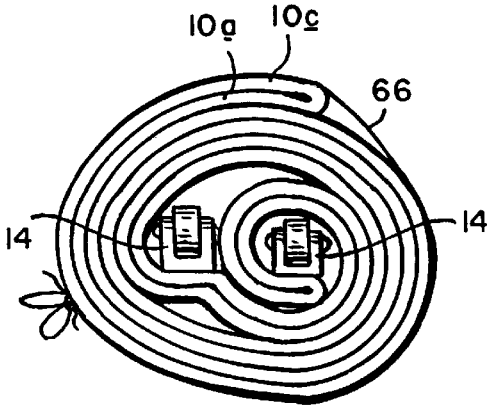
FIG. 6 is a perspective view of the collapsed case rolled up.

In order to gain access to the interior of the closed case, one simply unzips one of the panels 22, 24; the other panel will maintain loop 10 in its erect condition. Once the container has been emptied, the case may be collapsed. This is accomplished by unzipping and opening both panels 22, 24 allowing loop 10 to collapse on itself. Next, the flaps 58 securing struts 42 to the sheets 25 of the two panels are opened and the struts are separated from the respective sheets by bending them sufficiently to disengage one end of each strut from the associated pocket 44. Once the struts 42 are separated from the sheets, each sheet 25 may be folded along fold lines extending perpendicular to the hinge 26 at the opposite ends of that hinge. Then, the folded sheets may be wrapped around the loop bottom wall 10*b* inside the loop 10 collapsed diagonally as shown in FIG. 5. The case may be consolidated further by rolling up the collapsed structure shown in FIG. 5 beginning at the right hand end thereof to form the cylindrical package shown in FIG. 6. Preferably, a tie 66 is secured by rivets 68 or the like to the outside left end of loop top wall 10*a* as best seen in FIG. 2. That tie may be used to secure the rolled up case as shown in FIG. 6. Note that in the rolled up case, the rigid brackets 14 and wheels 14*a* are protectively enclosed near the center of the package. It is apparent from FIG. 6 that the collapsed case forms a relatively compact bundle which may be stowed away or secured by a bungee cord or the like to a carrier of a bicycle, motorcycle or the like.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings be interpreted as being illustrative and not in a limiting sense.

It is also to be understood that the following claims are intended to cover all of the generic and specific features of the invention described herein.

What is claimed is:

1. A collapsible case comprising a closed loop of flexible sheet material for forming the top, bottom and side walls of the case, said loop having front and rear edges defining front and rear openings into the interior of the loop;

a series of relatively stiff battens secured to said loop between said edges at spaced-apart locations all around said loop, said battens being substantially perpendicular to said edges thereby allowing the loop to be flattened and rolled up into a generally cylindrical package, a pair of similar panels for forming the front and rear walls of the case, each panel including a sheet of flexible material having a perimeter, means for stiffening said front and rear walls, attachment means for removably attaching said stiffening means to said sheet so as to tension and stiffen said sheet into a selected shape, and fastening means for fastening the perimeter of the sheet to the corresponding edge of the loop so that when said panels are fastened to said loop, said loop assumes said selected shape and when said panels are unfastened from said loop and said stiffening means are detached from said sheets, said loop and panels may be collapsed and consolidated into said cylindrical package.

2. The case defined in claim 1 wherein said loop comprises at least two sheet material layers and said batterns are sandwiched between said layers.

3. The case defined in claim 2 wherein said batterns are relatively stiff, generally rectangular slats.

4. The case defined in claim 1 wherein said fastening means include first fastener elements secured to the perimeter of each panel sheet, and second fastener elements secured to said edges of the loop, said first and second fastener elements cooperating to effect the fastening of the sheets to the loop.

5. The case defined in claim 4 wherein the fastening means comprise zippers.

6. A collapsible case comprising a closed loop of flexible sheet material for forming the top, bottom and side walls of the case, said loop having front and rear edges defining front and rear openings into the interior of the loop, and a pair of similar panels for forming the front and rear walls of the case, each panel including a sheet of flexible material having a perimeter, means for stiffening said front and rear walls, including at least one relatively stiff but resilient strut having opposite ends, attachment means for removably attaching said stiffening means to said sheet so as to tension and stiffen said sheet into a selected shape, said attachment means on each panel for comprising means for releasably securing the opposite ends of said at least one strut to the flexible sheet comprising that panel at opposite locations along the perimeter thereof, and fastening means for fastening the perimeter of the sheet to the corresponding edge of the loop, so that when said panels are fastened to said loop, said loop assumes said selected shape and when said panels are unfastened from said loop and said stiffening means are detached from said sheets, said loop and panels may be collapsed and consolidated.

7. The case defined in claim 6 and further including means defining a window in at least one of said panels through which indicia affixed to said panel may be viewed.

8. The case defined in claim 6 and further including a series of relatively stiff battens secured to said loop between said edges at spaced-apart locations around the loop, said batens being substantially perpendicular to said edges.

9. The case defined in claim 6 and further including wheels attached to the portion of the loop forming said bottom wall of the case.

10. The case defined in claim 6 and further including a hand grip attached to the portion of the loop forming said top wall of the case.

11. The case defined in claim 6 wherein the securing means include oppositely disposed pockets formed on said sheet for receiving the ends of said at least one strut.

12. The case defined in claim 11 wherein said attachment means also include at least one flap releasably fixed to said sheet so as to cover at least a segment of said at least one strut.

13. The case defined in claim 11 wherein said sheet is rectangular;

four pockets are located at the corners of said sheet, and two crossed struts have their ends releasably secured in diametrically opposite pockets on said sheet.

14. The case defined in claim 11 wherein each strut comprises an elongated generally rectangular slat.

15. The case defined in claim 6 wherein said sheets are hinged along portions of their perimeters to the corresponding edges of said loop.

16. The case defined in claim 6 and further including a tie affixed to the exterior of the loop for securing the collapsed and consolidated case.

17. A collapsible case comprising a closed loop of flexible sheet material for forming walls of the case, said loop having opposite edges with the same selected length and defining opposite openings into the interior of the loop;

a series of relatively stiff battens secured to said loop at spaced-apart locations around the loop, said battens extending between and being substantially perpendicular to said edges, and similar front and rear panels for closing said opposite openings in the loop, each panel including a sheet of flexible material having a perimeter equal in length to said selected length with a portion of said perimeter being hinged to the corresponding edge of said loop, means for releasably fastening the perimeter of said sheet to the corresponding edge of said loop, at least two elongated, relatively stiff but resilient struts, and means for releasably attaching said struts to said sheet so as to tension said sheet in two dimensions and so as to stiffen said panel so that when said fastening means fasten said sheet to the corresponding edge of said loop, said edge assumes the shape of said panel.

18. The case defined in claim 17 wherein said fastening means include first fastener elements secured to the perimeter of each sheet, and second fastener elements secured to said edges of the loop, said first and second fastener elements cooperating to affect the fastening of said sheets to said loop.

19. The case defined in claim 18 wherein the fastening means comprise zippers.

20. The case defined in claim 18 wherein the attachment means on each panel comprise means for releasably securing the opposite ends of each strut to the sheet comprising that panel at opposite locations along the perimeter thereof.

21. The case defined in claim 20 wherein said securing means include oppositely disposed pockets formed on said sheet for receiving the ends of said struts.

22. The case defined in claim 21 wherein said attachment means also include flaps releasably fixed to said sheet so as to cover segments of said struts between the ends thereof.

23. The case defined in claim 22 wherein said sheet is rectangular;

four pockets are located at the corners of the sheet, and two diagonal struts are releasably secured in said pockets.

24. The case defined in claim 23 wherein each batten and each strut is a generally rectangular slat.

* * * * *